10/6/87 OR 4,698,510

United States Patent [19]

Handke et al.

[11] Patent Number: 4,698,510

[45] Date of Patent: Oct. 6, 1987

[54] MULTIPLE RESERVOIR TRANSPORTATION ASSEMBLY FOR RADIOACTIVE SUBSTANCES, AND RELATED METHOD

[75] Inventors: Wayne A. Handke; Mark A. Priest, both of Duncan, Okla.

[73] Assignee: Halliburton Company, Duncan, Okla.

[21] Appl. No.: 823,885

[22] Filed: Jan. 29, 1986

[51] Int. Cl.[4] ..... G21F 5/00

[52] U.S. Cl. ..... 250/506.1; 250/507.1

[58] Field of Search ..... 250/423 R, 423 PD, 506.1, 250/507.1, 515.1; 376/272

[56] References Cited

U.S. PATENT DOCUMENTS

| | | | |
|---|---|---|---|
| 3,531,644 | 9/1970 | Koster . | |
| 3,655,985 | 4/1972 | Brown et al. . | |
| 3,732,427 | 5/1973 | Trudeau et al. | 250/506.1 |
| 4,092,546 | 5/1978 | Larrabee . | |
| 4,150,298 | 4/1979 | Brault et al. | 250/507.1 |
| 4,188,539 | 2/1980 | Strecker | 250/432 PD |
| 4,199,680 | 4/1980 | Moon . | |
| 4,239,970 | 12/1980 | Eckhardt et al. | 250/432 PD |
| 4,493,813 | 1/1985 | Loriot et al. . | |
| 4,497,349 | 2/1985 | Farley . | |

*Primary Examiner*—Bruce C. Anderson

*Attorney, Agent, or Firm*—E. Harrison Gilbert, III; Joseph A. Walkowski

[57] ABSTRACT

A transportation assembly includes a single container having a primary confinement receptacle and a secondary confinement receptacle in which the primary confinement receptacle is retained. In the preferred embodiment the primary confinement receptacle has two reservoirs defined in it, one of which is for storing and transporting a radioactive substance and the other of which is for storing and transporting a diluting substance in which the radioactive substance is to be diluted at a location, such as a well site at which a radioactive tracer injection operation is to be performed. A system incorporating such a container and a method of using it are also disclosed.

14 Claims, 4 Drawing Figures

MULTIPLE RESERVOIR TRANSPORTATION ASSEMBLY FOR RADIOACTIVE SUBSTANCES, AND RELATED METHOD

BACKGROUND OF THE INVENTION

This invention relates generally to apparatus for storing at least two substances, one of which is a radioactive substance, and to a related method of injecting the radioactive substance into a well with such an apparatus. More particularly, but not by way of limitation, the present invention relates to a dual fluid transportation assembly and method for storing and transporting a radioactive liquid and a diluting liquid in a single container and for subsequently storing in the assembly waste products comprising a mixture of the two substances.

Sometimes during oil or gas well fracturing operations, a radioactive fluid is injected into the fracturing fluid being pumped downhole. Such a radioactive fluid either gets trapped in the earthen formation or is deposited on the surface of the formation. Subsequent gamma ray logging operations will then locate where this radioactive "tracer" fluid is trapped in or deposited on the formation. The information from this logging operation is then used to determine where a fracture is created, its depth, its type, the aggregate number of fractures, an estimation of the fracture thickness, and the effectiveness of the fracturing method used.

In performing such a fracturing job wherein a liquid radioactive fluid is used, it has been typical to transport several small containers (e.g., ones having storage capacities of ten cubic centimeters) of radioactive tracer to the well site where the contents of the small containers are dumped into a fluid reservoir at the site. Such small containers have been glass bottles which have threaded screw caps attached and which are protectively housed during transportation in respective lead casings. Once such assemblies arrive at the well site, however, the unshielded bottles are removed and manipulated to pour their contents into the fluid reservoir, where the tracer is diluted from its stored concentrated form prior to being pumped through the tracer injection equipment.

Shortcomings of this technique include the risk of human, equipment and environmental contamination which can relatively easily occur either if humans directly handle the unprotected bottles of concentrated radioactive fluid or if they handle them indirectly with mechanical tongs or other extra equipment at the well site. When such a dangerous substance is handled by either manner at the well site itself, there is a relatively high risk of spillage due to mishandling of the container and due to less than ideal weather conditions. Although the risk of direct contamination of humans may be reduced by using a mechanical handling device, the risk of spillage, and thus of environmental contamination, may be higher with respect to the use of such mechanical equipment because such mechanical handling is likely less sensitive and controllable than direct human handling. The risk of direct human contamination would be greater through such direct handling, however, since the bottles are not shielded when they are removed from their lead casings to transfer the fluid, particularly when the contents of the bottles have the high radioactivity levels that can be associated with the concentrated types of radioactive substances used and when such substances are highly absorbable.

A further disadvantage of the aforementioned technique is that contaminated bottles remain after their contents have been poured into the fluid reservoir. There can be numerous such bottles at the well site if a large quantity of tracer is needed because of the small individual quantities of each bottle.

Additionally, the use of a separate fluid reservoir located at the well site presents another potential hazard because it may be a large open tank or other receptacle which may not be suitable for adequate containment of radioactive substances. Furthermore, such a separate reservoir can become contaminated once the radioactive substance is poured into it, and the rest of the equipment by which the diluted radioactive substance is pumped into the well can become similarly contaminated. Such contaminated equipment presents radioactivity exposure and contamination risks to humans and the environment.

The last-mentioned shortcoming of contaminated equipment is particularly significant with respect to the typical radioactive tracer injection system currently being used in the oil industry because in such a system, the tracer fluid is metered from the reservoir, into which the tracer has first been added (which transfer is itself subject to significant risk), to the suction inlets of high pressure fracturing pumps which are not necessarily dedicated solely for radioactive use. Because usage with radioactive tracers can contaminate such pumps, the pumps must be appropriately cleaned or disposed of to avoid subsequent risks of exposure or contamination. This is difficult to control since such pumps are not necessarily dedicated to only one well site or to only one injection or fracturing job. Thus, aside from the significant human health hazards arising from such equipment, such contaminated equipment can lead to the pertinent governmental regulatory body issuing citations, imposing fines, and revoking licenses.

Even assuming proper handling of the small glass bottle containers and the injection equipment, there is the significant additional risk arising from the contaminated waste fluids often remaining after such an injection job, but for which there may be no adequate disposal containers provided. Thus, proper disposal equipment must also be provided at the well site to reduce the chances of the waste fluids being improperly and unsafely dumped into the environment.

In view of the shortcomings of this small glass bottle/separate reservoir and disposal equipment/contaminated injection system by which radioactive tracer substances are injected into a well, such as during fracturing operations, there is the need for a new type of radioactive substance container to transport the substance safely and to overcome the problems arising from the use of a separate fluid reservoir at the well site (into which the tracer substance has heretofore been transferred under whatever weather conditions existed at the well site) and from the contamination of the injection equipment and from the need to dispose of contaminated waste substances. Such a need could be satisfied by a single multiple-reservoir container for holding both the concentrated radioactive substance and the diluting substance which would otherwise be contained in the separate external fluid reservoir. Such a container should have a significantly increased storage capacity over the small glass bottle containers so that only one, or at most only a few, containers are needed at the well site to reduce the handling of the substances and their containers. Such a container should also be constructed so that transfers of the radioactive substance can be made within a closed system to prevent weather conditions at the well site from affecting the transfer and to otherwise prevent or reduce the risk of spillage. Additionally, such a container needs to be constructed to meet pertinent regulatory requirements, such as those pertaining to containers by which radioactive substances are transferred from or to locations remote from the well site.

In addition to the foregoing needs pertaining particularly to the container, there is the further need for a system, including a method, by which such a novel container is used to avoid contaminating the injection equipment found at the well site, which equipment may be needed for other purposes.

SUMMARY OF THE INVENTION

The present invention overcomes the above-noted and other shortcomings of the prior art by providing a novel and improved multiple fluid reservoir transportation assembly and associated method of use. One specifically contemplated use (to which the description of the invention will be referenced) is with a radioactive tracer substance and a diluting substance to be mixed and injected into an oil or gas well during a fracturing operation; however, the scope of the present invention is not limited to such a use or to the oil industry.

The present invention includes a container assembly which holds both the radioactive substance and its diluting substance. This assembly also functions as a waste reservoir to receive contaminated waste products arising from the injection operation. The assembly has a relatively large capacity so that a single assembly of the present invention replaces many individual units of the small glass bottle containers known to be previously used.

The container has primary and secondary confinement receptacles assembled in a closed system constructed in its preferred embodiment so that weather conditions do not affect transfers. Thus, with this preferred embodiment there are no uncontrolled transfers where external spillage is likely to occur. Also in accordance with the preferred embodiment of the present invention, the container assembly is constructed to meet United States Department of Transportion regulations pertaining to containers in which radioactive substances can be transported.

The present invention, when properly constructed and used, can prevent or reduce risks of exposing and contaminating humans, equipment and the environment to radioactivity from radioactive substances which must be stored, transported, used, and disposed. Furthermore, there are no contaminated components of the present invention which might be easily lost or misplaced at the well site, which loss or misplacement might easily occur with the numerous smaller-quantity glass bottles of the prior art.

Broadly, the present invention provides an apparatus for transporting a radioactive substance, comprising a radioactivity shielding container having defined therein first reservoir means for receiving the radioactive substance and second reservoir means for receiving another substance. This container includes a primary confinement receptacle having the first and second reservoir means defined therein, and it also includes a secondary confinement receptacle having the primary confinement receptacle disposed therein. This container also includes first communicating means for communicating the radioactive substance through the secondary confinement receptacle and into the first reservoir means, second communicating means for communicating a diluting substance through the secondary confinement receptacle and into the second reservoir means, third communicating means for communicating the radioactive substance from the first reservoir means and through the secondary confinement receptacle and for communicating the diluting substance from the second reservoir means and through the secondary confinement receptacle so that the radioactive substance and the diluting substance can be mixed, and fourth communicating means for communicating a waste substance, derived from the mixed radioactive substance and diluting substance, through the secondary confinement receptacle and into the second reservoir means.

The method of the present invention includes transferring the radioactive substance into the first reservoir means of the single radioactivity shielding container, transferring a diluting substance into the second reservoir means of the container, moving the container to the well site, flowing the radioactive substance from the first reservoir means, flowing the diluting substance from the second reservoir means into the flowing radioactive substance for mixing therewith, flowing at least a portion of the mixed radioactive substance and diluting substance into the well, and flowing any remaining portion of the mixed radioactive substance and diluting substance into the second reservoir means of the container. In the preferred embodiment, the step of flowing at least a portion of the mixed substances into the well includes connecting an outlet of a pressurizing pump, into which the radioactive substance is metered, in direct communication with the mouth of the well, which allows a direct flow of the radioactive mixture into the well, thereby preventing or reducing the risk of contaminating any equipment which is not specifically dedicated within the system of the present invention.

Therefore, from the foregoing, it is a general object of the present invention to provide a novel and improved multiple reservoir transportation assembly for a radioactive substance and a related method. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
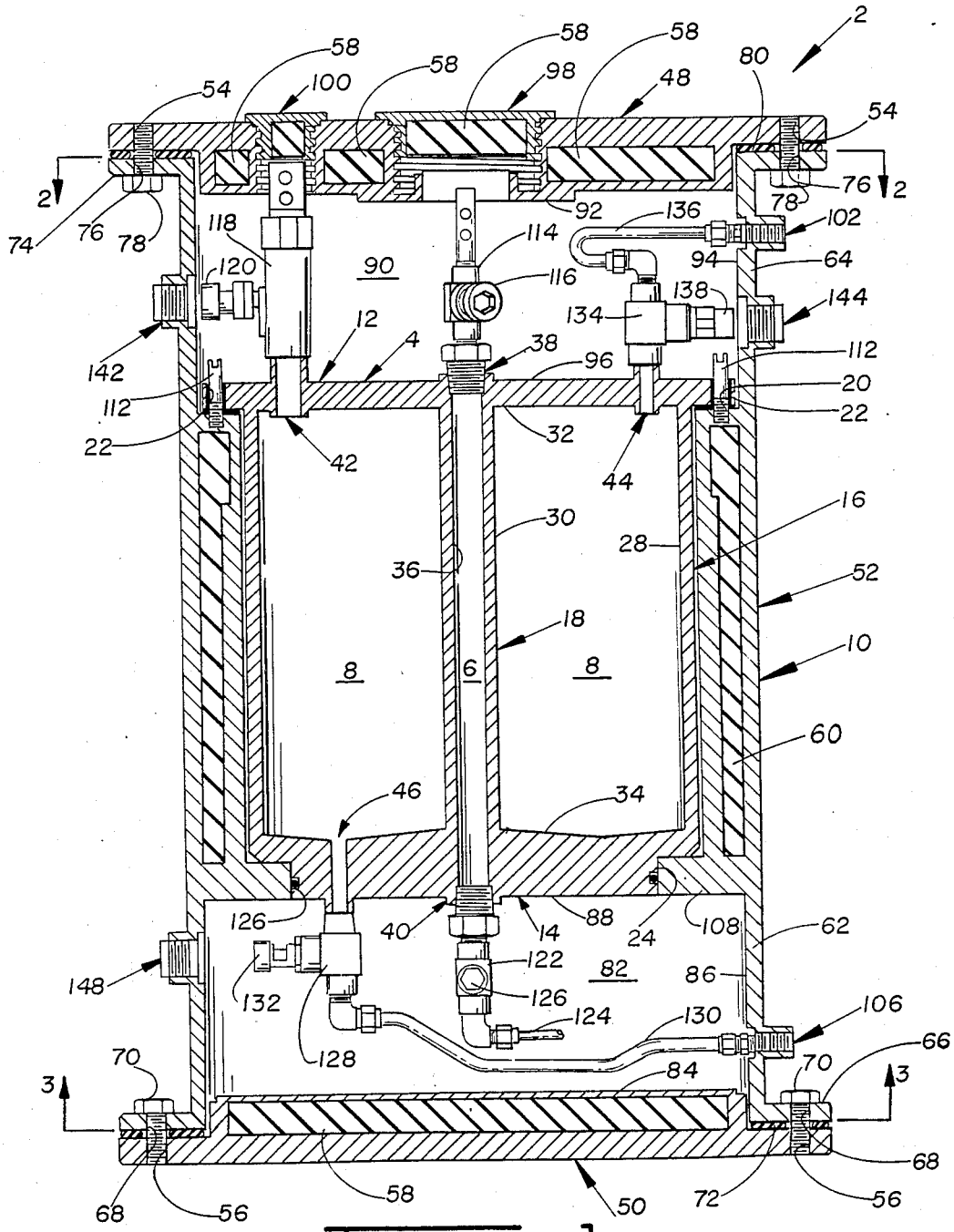
FIG. 1 is a sectional elevational view of the container of the preferred embodiment of the present invention.
Figure 2:
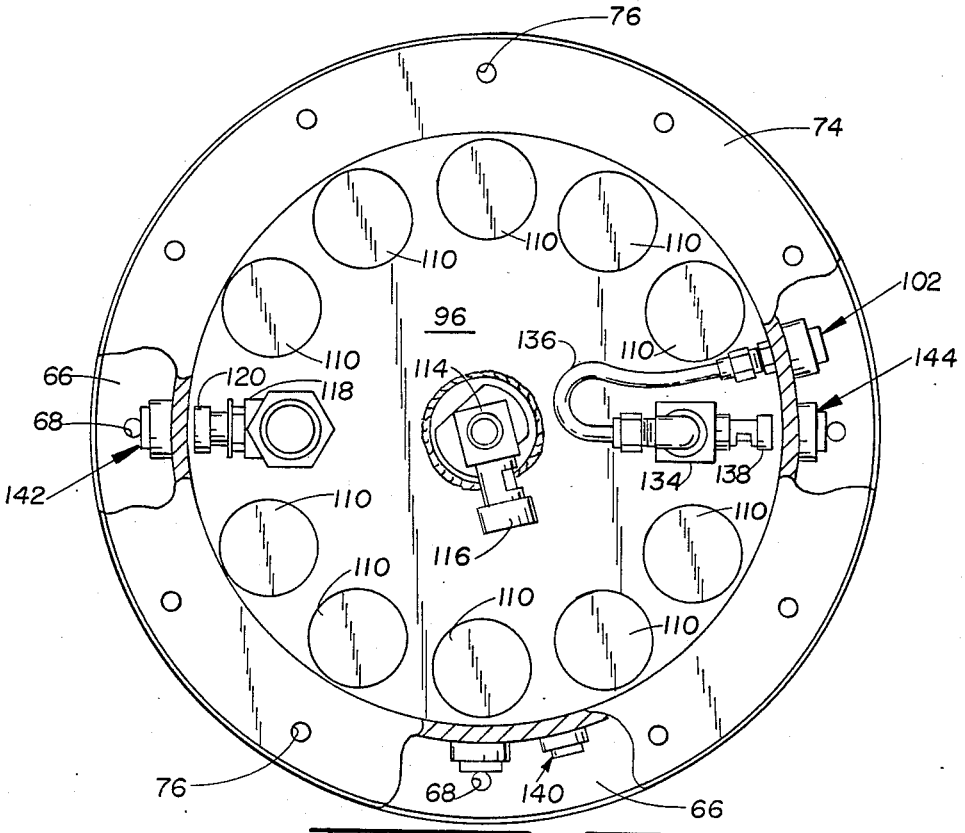
FIG. 2 is a first end plan view taken along line 2—2 shown in FIG. 1.
Figure 3:
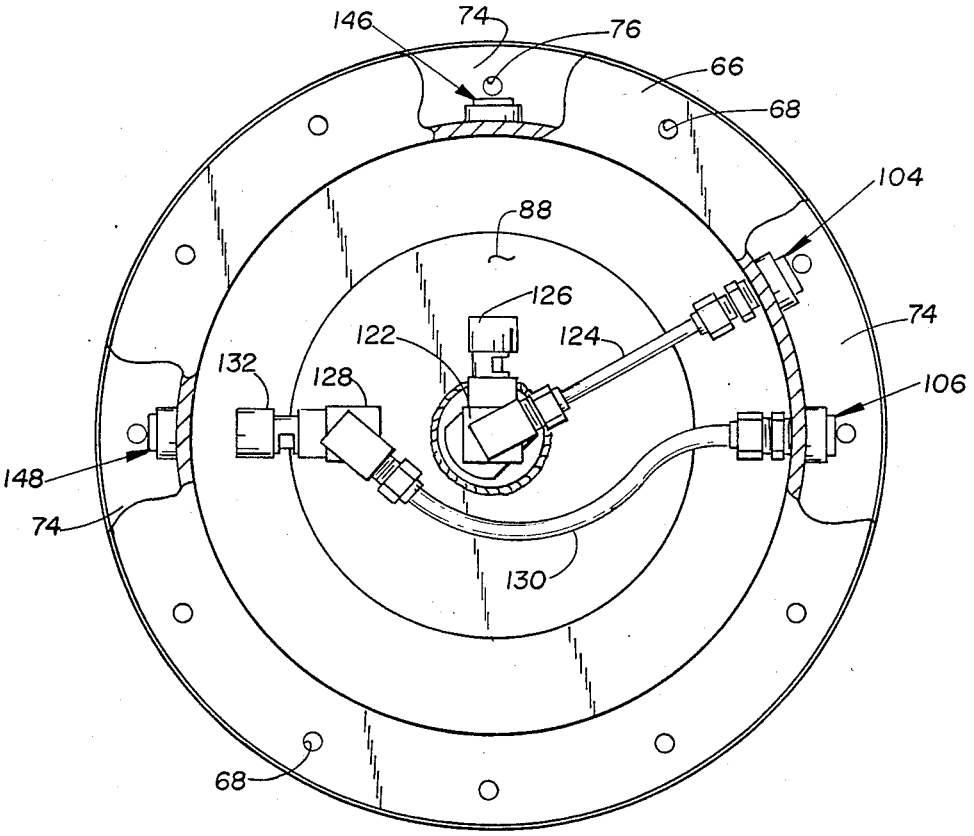
FIG. 3 is a second end plan view taken along line 3—3 shown in FIG. 1.

The preferred embodiment of a multiple reservoir transportation container assembly 2 for transporting a radioactive substance is shown in FIGS. 1-3. The assembly 2 is to be used both in place of numerous small glass bottle containers which have previously been used to transport radioactive substances to a well site and in place of a separate injection fluid reservoir. Thus, the present invention provides a single integrated container as a substitute for several individual containers and an external or separate injection reservoir.

The container 2 of the preferred embodiment includes a primary confinement receptacle 4 having two reservoirs 6, 8 defined therein for separately receiving and holding two substances. The container 2 also includes a secondary confinement receptacle 10 in which the primary confinement receptacle 4 is retained. Various stop means are included in the container 2 for fixing the relationship of the primary confinement receptacle 4 relative to the secondary confinement receptacle 10. The container 2 also broadly includes various conduit means forming parts of means for communicating the substances into and out of the container 2. These broad aspects of the preferred embodiment of the container 2 will be more particularly described with reference to FIGS. 1–3.

The primary confinement receptacle 4 of the preferred embodiment is a dual fluid reservoir subassembly (although the preferred embodiment of the present invention will be described with respect to fluids, specifically liquids, it is contemplated that the present invention could be adapted for use with other types of substances). This subassembly is an integrally formed body of suitable material (such as steel or other material which need not provide significant radioactivity shielding) having an end wall 12, an opposite end wall 14, and an outer side wall 16 and an inner side wall 18 extending perpendicularly between the end walls 12, 14. The end walls 12, 14 of the preferred embodiment are substantially circular in shape, and the end wall 12 has a flange or rim portion 20 extending radially outwardly from the cylindrically shaped outer side wall 16. The flange 20 has a plurality of longitudinally extending openings or holes 22 defined therethrough. The end wall 14 has a circumferential groove 24 defined therein, in which groove a seal member 26 is retained.

The inner side wall 18 is also cylindrically shaped, and it is disposed concentrically within the primary confinement receptacle 4 relative to the outer side wall 16. This relationship of the side walls 16, 18 defines an annular cavity or chamber between an interior surface 28 of the side wall 16 and an outer surface 30 of the side wall 18. This annular cavity is also defined by facing surfaces 32, 34 of the end walls 12, 14, respectively. This cavity is the reservoir means 8 for receiving and holding a diluting fluid of a type as known to the art for use in diluting the radioactive tracer liquid to be retained in the reservoir 6 and to be subsequently diluted and injected into a well during a fracturing operation. The cavity or reservoir 8 also serves as a return or disposal reservoir for waste fluids as subsequently described. In the preferred embodiment the reservoir 8 has a five-gallon capacity. This reservoir 8 surrounds the reservoir 6 as best seen in FIG. 1.

The reservoir 6 is defined by a cavity bounded, at least in part, by an inner surface 36 of the inner side wall 18. This cavity has a 100 cubic centimeter capacity in the preferred embodiment (as compared to the ten cubic centimeter capacities of the prior art glass bottles), and it provides the reservoir in which the exemplary undiluted radioactive tracer liquid is to be received and stored. This cavity extends longitudinally (specifically, axially) through and is disposed centrally within the primary confinement receptacle 4 between the two end walls 12, 14.

For communicating the respective fluids into and out of the reservoirs 6, 8, the primary confinement receptacle 4 further includes various inlet and outlet means. In the preferred embodiment shown in FIGS. 1–3, these means include an inlet port 38 at the mouth of the cavity defined by the inner surface 36, an outlet port 40 also communicating with the cavity defining the reservoir 6, two inlet ports 42, 44 providing communication into the reservoir 8, and an outlet port 46 also communicating with the reservoir 8. The inlet ports 38, 42, 44 are disposed through the end wall 12, and the outlet ports 40, 46 are disposed through the end wall 14. These inlet ports and outlet ports form parts of the various communicating means which will be more fully described hereinbelow.

Although the primary confinement receptacle 4 is the body in which the fluids are intended to be stored, it is housed within the secondary confinement receptacle 10, which is constructed to also contain or confine the fluids should there be leakage from the primary confinement receptacle 4. The secondary confinement receptacle 10 also provides radioactivity shielding to protectively encase the radioactivity emanating from the fluid stored in the primary confinement receptacle 4, and it further provides a sturdy structure for otherwise protectively housing the primary confinement receptacle 4.

The secondary confinement receptacle 10 provides, in the preferred embodiment, a lead shield subassembly including end wall members 48, 50 and side wall member 52. The end members 48, 50 have substantially circular shapes. The end wall member 48 has a plurality of openings or holes 54 defined around its perimeter, and the end wall member 50 has similar holes 56 defined around its perimeter. Each of the end wall members 48, 50 has one or more respective cavities in which a radioactivity shielding material is disposed. In the preferred embodiment, this shielding material is lead. Each of these cavities and its associated lead filled component are generally identified in the drawings by the same reference numeral 58.

The side wall member 52 has a central shielding portion in which a cavity and lead-filled component or section 60 are disposed. The section 60 has a length which is substantially coextensive with the height of the reservoirs 6, 8 of the primary confinement receptacle 4, which is mounted in the secondary confinement receptacle 10 so that the reservoir 6, the reservoir 8 and the shielding section 60 are substantially concentrically related with the shielding section 60 being the outermost element to prevent or reduce the penetration of any radioactivity from the container 2.

The side member 52 also has two skirt portions 62, 64 extending from opposite ends of the central portion in which the shielding section 60 is disposed. The skirt portions 62, 64 are substantially annular in shape whereby they circumscribe hollow or vacant regions.

The skirt portion 62 terminates in a radially outwardly extending flange 66 through which openings or holes 68 are disposed. The holes 68 are aligned with the holes 56 in the end wall member 50 and suitable fasteners, such as bolts 70, are threadedly connected through the aligned openings 68, 56. A sealing gasket 72 is used between the coupled surfaces of the end wall member 50 and the side wall member 52 to provide a fluid-tight seal.

The skirt portion 64 terminates in a similar flange, identified in the drawings by reference numeral 74, through which openings or holes 76 are formed for aligning with the openings or holes 54 in the end wall member 48. Suitable fasteners, such as bolts 78, threadedly connect the end wall member 48 to the side wall member 52. A sealing gasket 80 provides a fluid-tight seal between the coupled surfaces of the end wall member 48 and the side wall member 52.

Upon connecting the end wall member 50 to the side wall member 52 by the suitable connector means, a hollow region 82 is defined at least in part by surfaces 84, 86, 88 of the end wall member 50, the skirt portion 62 of the side wall member 52, and the primary confinement receptacle 4, respectively. The connection of the end wall member 48 to the side wall member 52 by the suitable connector means defines another hollow region, identified by the reference numeral 90, defined at least in part by surfaces 92, 94, 96 of the end wall member 48, the skirt portion 64 of the side wall member 52, and the primary confinement receptacle 4.

The secondary confinement receptacle 10 has entry and exit means forming parts of the communicating means by which the substances are transferred to and from the reservoirs 6, 8. The end wall 48 includes an entry port 98 and an entry port 100 which are associated with the inlet ports 38, 42, respectively, as more particularly described hereinbelow. In the preferred embodiment, the inlet port 98 has a specific construction so that it can align and couple with a smaller syringe receptacle which can be used for transferring the radioactive substance directly into the reservoir 6. Preferred embodiments of such a syringe receptacle are described in a copending United States patent application Ser. No. 823,876 filed Jan. 29, 1986, entitled "Radioactivity Shielding Transportation Assembly and Method" and assigned to the assignee of the present invention.

The fluid communicating ports of the secondary confinement receptacle 10 also include an entry port 102 defined in the skirt portion 64 of the side wall member 52 and two exit ports 104, 106 defined through the skirt portion 62 of the side wall member 52.

Although the primary confinement receptacle 4 is removable from the secondary confinement receptacle 10, such as for cleaning or disposing of the receptacle 4 to avoid subsequent contamination, the primary confinement receptacle 4 is held in a fixed or rigid relationship relative to the secondary confinement receptacle 10 when the two are related in the assembly depicted in the drawings. This fixed or rigid relationship is intended to protect the primary confinement receptacle 4 should the container 2 be dropped, hit or otherwise disturbed. That is, it is intended that the secondary confinement receptacle 10 absorb any damage which may arise during usage of the container 2, with the primary confinement receptacle 4 being protected to avoid any leakage or loss of the radioactive substance. To achieve this relationship, the container 2 includes the various stop means for preventing relative movement between the primary confinement receptacle 4 and the secondary confinement receptacle 10.

One of these stop means includes a shoulder 108 (see FIG. 1) extending radially inwardly from the secondary confinement receptacle near the junction of the central portion, containing the shielding section 60, and the skirt portion 62 of the side wall member 52. The shoulder 108 is rigid and is integrally formed with the side wall member 52. The shoulder 108 engages or receives the primary confinement receptacle 4 at the circumferential groove or offset 24 defined in the end wall 14. The shoulder 108 prevents the primary confinement receptacle 4 from sliding in a downward direction (for the orientation as viewed in FIG. 1) relative to the secondary confinement receptacle 10.

Another stop means of the container 2 is provided by a plurality of compression members 110 disposed longitudinally around the periphery of the end wall 12 of the primary confinement receptacle 4. The members 110, formed as cylindrical metal bars in the preferred embodiment, are not shown in FIG. 1 for purposes of simplicity but are depicted in FIG. 2. The compression members 110 rest on top of the end wall 12 and extend upwardly (as would be viewed in FIG. 1) into engagement with the surface 92 of the end wall member 48 of the secondary confinement receptacle 10. With this disposition of the members 110, movement of the primary confinement receptacle in the direction toward the end wall member 48 is prevented if the container 2 should be dropped on the end wall member 48, for example. The compression members 110 are restricted in their lateral movement by being mounted on respective pins 112 forming part of another stop means of the container 2.

This third described stop means includes the plurality of pins 112 and the plurality of holes or openings 22 defined through the end wall 12 of the primary confinement receptacle 4 for receiving the pins 112. The pins 112 are threadedly connected to the secondary confinement receptacle 10 as shown in FIG. 1, but the holes 22 do not engage the pins 112 in a vertical movement restricting manner so that the primary confinement receptacle 4 is fixed by the laterally engaging pins 112 and holes 22 from rotating relative to the secondary confinement receptacle 10, but it is free to move vertically along the length of the pins 112 except to the extent limited by the compression members 110. That is, the primary confinement receptacle 4 is in a "free-floating" relationship relative to the secondary confinement receptacle 10, but for the movement limitations imposed by the rigid shoulder 108 (and the flange 20 and the adjacent abutment portion of the secondary confinement receptacle 10 in which the pins 112 are anchored) and the rigid compression bars 110.

The conduit means for defining the various confined flow paths between respective entry ports and inlet ports and between respective outlet ports and exit ports each includes a respective ordinary type of ball valve and associated means for connecting such valves between the respective ports. A valve 114 is shown in FIG. 1 connected between the inlet port 38 and extending upwardly toward the entry port 98 so that the valve 114 is disposed in the hollow region 90 and so that the radioactive substance is transferred into the reservoir 6 through the conduit provided through the valve 114. Attached to the stem of the valve 114 is a suitable adapter 116 for receiving an implement by which the valve 114 can be actuated between its open and closed position as will be more particularly described hereinbelow. The valve 114, its associated connections and the ports 38, 98 define a communicating means for communicating the radioactive substance through the secondary confinement receptacle 10 and into the cavity or reservoir 6.

A valve 118 is connected by suitable means between the inlet port 42 and the entry port 100 so that the valve 118 is also disposed in the hollow region 90 as shown in FIG. 1. An adapter 120 is connected to the stem of the valve 118 for receiving a suitable actuating implement as more particularly described hereinbelow. The valve 118, its associated connections and the ports 42, 100 define another communicating means, this one for communicating a diluting substance (in the exemplary use) through the secondary confinement receptacle 10 and into the cavity or reservoir 8.

A valve 122 is shown disposed in the hollow region 82 and is connected, at least in part, by a stainless steel tubing 124, between the outlet port 40 and the exit port 104 as best shown in FIG. 3. The valve 122 has an adapter 126 for receiving a suitable actuating implement as subsequently described. The valve 122, its associated coupling or connector elements and the ports 40, 104 define part of a means for communicating the radioactive substance from the reservoir 6 and through the secondary confinement receptacle 10 and for communicating the diluting substance from the reservoir 8 and through the secondary confinement receptacle 10 so that the radioactive substance and the diluting substance can be mixed.

The other portion of this communicating means by which the diluting substance is transferred out of the container 2 includes a valve 128 connected, at least in part, by a stainless steel tubing 130 between the outlet port 46 and the exit port 106. The valve 128 has an adapter 132 connected to its stem for receiving a suitable actuating implement. As shown in the drawings, the valve 128 and tubing 130 are also disposed in the hollow region 82.

Another communication path into the reservoir 8, this one for receiving a waste substance in the exemplary use, includes a valve 134 disposed in the hollow region 90 and connected between the entry port 102 and the inlet port 44. Connected to the valve 134 is a stainless steel tubing 136. Connected to the stem of the valve 134 is an adapter 138 for receiving a suitable actuating implement as subsequently described.

The aforementioned adapters of the respective valves are of standard types so that they receive a suitable actuating implement of a type as known to the art through a respective port defined in the side wall member 52. An access port 140 is provided in alignment with the adapter 116 as shown in FIG. 2. An access port 142 is provided in alignment with the adapter 120. An access port 144 is associated in alignment with the adapter 138. Both of the access ports 142, 144 are shown in FIG. 2. Access ports 146, 148 aligned with the adapters 126, 132, respectively, are shown in FIG. 3. Each of the access ports has a similar size which in absolute terms is of a suitable dimension for receiving a common type of plug by which the access ports can be sealingly stoppered or plugged to enable the receptacle 10 to function as a secondary confinement member.

Figure 4:
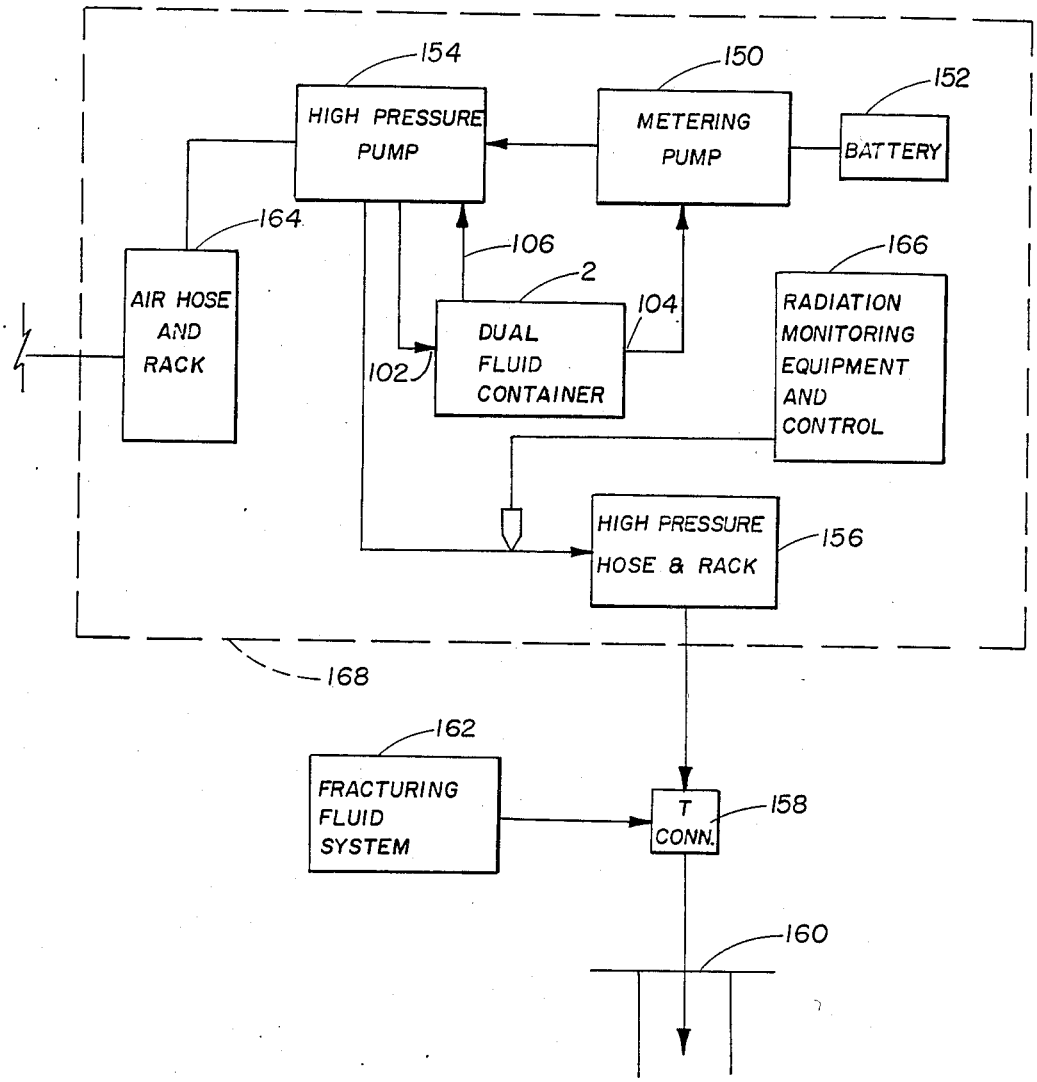
FIG. 4 is a functional block diagram depicting the system of the preferred embodiment of the present invention.

A specific system in which the dual fluid container 2 can be used for effecting high pressure liquid radioactive tracer injection during a fracturing operation at a well site is shown in FIG. 4. The exit port 104 of the container 2, through which the radioactive substance is output, is connected to an inlet of a metering pump 150 of a suitable type as known to the art. In the preferred embodiment the metering pump is a lower pressure, electrically powered pump for accurately metering the radioactive substance from the container 2. The energization of the metering pump 150 is shown in FIG. 4 to be by means of a suitable battery 152.

The outlet of the metering pump 150 is connected to an inlet of a high pressure pump 154 having another inlet connected to the exit port 106 through which the diluting substance is output from the container 2. An outlet of the pump 154 is connected to the entry port 102 so that the substance contained in the reservoir 8 can be recirculated from the port 106 and back to the port 102 when the pump 154 is being primed or so that any radioactive waste or residue mixture which remains in the pump 154 after the tracer injection operation has been completed can be pumped or otherwise flowed into the reservoir 8 for safe storage and disposal.

Through the same or another outlet of the pump 154, the diluted radioactive tracer mixture is communicated to a high pressure hose and rack assembly 156, from which the mixture flows to a tee connector 158 located directly at the mouth of a well 160 into which the tracer fluid is to be injected. The other inlet to the connector 158 is connected to the general fracturing fluid system 162 being utilized at the well site and of a type as known to the art.

The pump 154 is a pneumatic pump energized by a suitable source of air received through an air hose and rack assembly 164.

The system also includes a radiation monitoring equipment and control section 166 for monitoring the radioactivity of the tracer injection fluid flowing into the high pressure hose and rack assembly 156 and for controlling the operation of the pumps 150, 154.

The components 2, 150, 152, 154, 156, 164, 166 of this preferred embodiment system are mounted on a canopy-covered, wheeled trailer 168 of a suitable type. This self-contained system is dedicated solely to the injection of radioactive substances so that, by having all of the components mounted on a single trailer, adequate supervision and maintenance of the components can be easily accomplished.

With such a system, the method of injecting a radioactive substance into a well as contemplated by the present invention can be achieved. This method comprises the steps of transferring the radioactive substance into the cavity 6 of the single radioactivity shielding container 2, transferring a diluting substance into the cavity 8 of the container 2, moving the container 2 to the well, flowing the radioactive substance from the cavity 6, flowing the diluting substance from the cavity 8 into the flowing radioactive substance for mixing therewith, flowing at least a portion of the mixed radioactive substance and diluting substance into the well, and flowing any remaining portion of the mixed radioactive substance and diluting substance into the cavity 8. In the preferred embodiment, the step of flowing at least a portion of the mixed substances into the well includes pumping a fracturing fluid, such as from the system 162, into a fluid coupling apparatus, such as the connector 158, attached to the wellhead of the well and pumping the mixed radioactive substance and the diluting substance into the fluid coupling apparatus. By performing these steps in this manner so that the radioactive mixture is pumped directly into the mouth of the well, the equipment of the fracturing fluid system 162 is not contaminated.

With specific reference to the system shown in FIG. 4, the dual fluid container 2 is filled with the radioactive and diluting substances at a field camp under ideal conditions, which field camp is located remotely from the field location of the well site. The system, including the container 2, is transported on the trailer 168 by a suitable pulling vehicle. At the well site, the air hose of the assembly 164 is connected to an air compressor and the radiation monitoring probe of the assembly 166 is connected to the discharge line from the pump 154. The pump 154 is primed with fluid by recirculating fluid in and out of the reservoir 8 through the exit port 106 and the entry port 102. When the radioactive tracer substance is to be injected into the well 160, the low pressure metering pump 150 is turned on at the required tracer flow rate, and the undiluted tracer substance is metered out of the reservoir 6 through the exit port 104 and into the suction of the pressurizing injection pump 154. The pump 154 receives the diluting substance directly into a suction inlet from the exit port 106, and the pump 154 mixes the two previously stored substances and injects the resultant mixture of radioactive tracer fluid and diluting fluid directly into the fracturing fluid through the high pressure tee connector 158 connected in direct communication with the well 160. When the injection job has been completed, the fluid remaining in the system's suction and discharge lines is air purged back into the reservoir 8, through the entry port 102, for subsequent disposal. During the injection operation, the radiation level is monitored through the equipment of the assembly 166 and a suitable recording is made.

From the foregoing aspects of the present invention, it is apparent that the container 2 provides an improved means for receiving and transporting a radioactive substance. As to its storage capabilities, it can be filled at a remote location under ideal conditions with a relatively large supply of radioactive substance. Additionally, with the present invention there is no need to transfer the radioactive substance from its container into a separate injection fluid reservoir at the well site because the container 2 is its own reservoir. The container 2 also functions as a waste return receptacle. As to its transporting capabilities, the preferred embodiment of the present invention has been constructed to meet United States Department of Transportation regulations through its dual confinement receptacles and its sturdy construction, whereby radioactive fluid can be stored in the container 2 and legally transported on public highways to the well site.

When the container 2 is used in a system such as that shown in FIG. 4, the radioactive tracer can be injected directly into the well without contaminating other equipment at the well site. This bypasses previously used pumps and discharge lines which now no longer need to become contaminated with radioactive tracer fluids, thereby eliminating or reducing grounds for citations or fines by regulatory personnel. This, of course, also reduces the chance of exposure or contamination of personnel and the environment.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts and the performance of steps can be made by those skilled in the art, which changes are encompassed within the spirit of this invention as defined by the appended claims.

What is claimed is:

1. A container for transporting a radioactive substance, comprising:

a primary confinement receptacle having a first reservoir means for receiving the radioactive substance and a second reservoir means substantially surrounding said first reservoir means for receiving and maintaining another substance in said primary confinement receptacle in isolation from said radioactive substance; and a secondary confinement receptacle having said primary confinement receptacle disposed therein.

2. An apparatus as defined in claim 1, wherein said primary confinement receptacle includes:

an outer side wall having an interior surface; and an inner side wall, having an outer surface and an inner surface, spaced from said outer side wall so that said inner surface forms at least a portion of a side of a first cavity and so that said interior and outer surfaces form respective sides of a second cavity, said first cavity defining said first reservoir means and said second cavity defining said second reservoir means.

3. An apparatus as defined in claim 1, wherein said container further includes:

first stop means for preventing movement of said primary confinement receptacle in a first direction relative to said secondary confinement receptacle; and second stop means for preventing movement of said primary confinement receptacle in a second direction relative to said secondary confinement receptacle.

4. An apparatus as defined in claim 3, wherein:

said first stop means includes a shoulder extending from said secondary confinement receptacle into engagement with said primary confinement receptacle; and said second stop means includes a plurality of compression members extending between said primary confinement receptacle and said secondary confinement receptacle.

5. An apparatus as defined in claim 3, wherein said container further includes third stop means for preventing rotational movement of said primary confinement receptacle relative to said secondary confinement receptacle.

6. An apparatus as defined in claim 5, wherein said third stop means includes a plurality of pins connected to said secondary confinement receptacle and a plurality of holes defined in said primary confinement receptacle for receiving said plurality of pins.

7. An apparatus as defined in claim 1, wherein:

said secondary confinement receptacle includes:

first entry means for providing an entry port for the radioactive substance;

second entry means for providing an entry port for the other substance; and first exit means for providing an exit port for the radioactive substance;

said primary confinement receptacle includes:

first inlet means for providing an inlet into said first reservoir means;

second inlet means for providing an inlet into said second reservoir means; and first outlet means for providing an outlet from said first reservoir means; and said container further includes:

first conduit means for providing a confined flow path between said first entry means and said first inlet means;

second conduit means for providing a confined flow path between said second entry means and said second inlet means; and third conduit means for providing a confined flow path between said first outlet means and said first exit means.

8. An apparatus as defined in claim 7, wherein:

said secondary confinement receptacle further includes:

third entry means for providing an entry port for a further substance; and second exit means for providing another exit port;

said primary confinement receptacle further includes:

third inlet means for providing another inlet into said second reservoir means; and second outlet means for providing an outlet from said second reservoir means; and said container further includes:

fourth conduit means for providing a confined flow path between said third entry means and said third inlet means; and fifth conduit means for providing a confined flow path between said second outlet means and said second exit means.

9. An apparatus as defined in claim 7, wherein said first entry means includes alignment means for coupling with a radioactive substance injector apparatus so that an injector member of the injector apparatus is received by said first conduit means.

10. An apparatus for transporting a radioactive substance, comprising:

a primary confinement receptacle having a first cavity defined therein and having a second cavity defined therein:

a secondary confinement receptacle having said primary confinement receptacle removably retained therein;

first communicating means for communicating the radioactive substance through said secondary confinement receptacle and into said first cavity;

second communicating means for communicating a diluting substance through said secondary confinement receptacle and into said second cavity;

third communicating means for communicating the radioactive substance from said first cavity and through said secondary confinement receptacle and for communicating the diluting substance from said second cavity and through said secondary confinement receptacle so that the radioactive substance and the diluting substance can be mixed outside of said secondary confinement receptacle; and fourth communicating means for communicating a waste substance, derived from the mixed radioactive substance and diluting substance, to return the waste substance through said secondary confinement receptacle and into said second cavity.

11. An apparatus as defined in claim 10, wherein said secondary confinement receptacle includes:

a first end member having a radioactivity shielding substance disposed therein;

a side member having a central shielding portion in which a radioactivity shielding substance is disposed and into which said primary confinement receptacle is received, having a first skirt portion extending from a first end of said central portion, and having a second skirt portion extending from a second end of said central portion;

a second end member having a radioactivity substance disposed therein;

first connector means for fluid tightly connecting said first end member to said side member adjacent said first skirt portion so that a first hollow region is defined at least in part by said first end member, said first skirt portion and said primary confinement receptacle; and second connector means for fluid tightly connecting said second end member to said side member adjacent said second skirt portion so that a second hollow region is defined at least in part by said second end member, said second skirt portion and said primary confinement receptacle.

12. An apparatus as defined in claim 11, wherein:

said first communicating means includes:

a first entry port defined through said first end member;

a first inlet port defined in said primary confinement receptacle in communcation with said first cavity;

a first valve; and means for connecting said first valve between said first entry port and said first inlet port so that said first valve is disposed within said first hollow region;

said second communicating means includes:

a second entry port defined through said first end member;

a second inlet port defined in said primary confinement receptacle in communication with said second cavity;

a second valve; and means for connecting said second valve between said second entry port and said second inlet port so that said second valve is disposed within said first hollow region;

said third communicating means includes:

a first outlet port defined through said primary confinement receptacle in communication with said first cavity;

a first exit port defined through said second skirt portion;

a third valve;

means for connecting said third valve between said first outlet port and said first exit port so that said third valve is disposed within said second hollow region;

a second outlet port defined through said primary confinement receptacle in communication with said second cavity;

a second exit port defined through said second skirt portion;

a fourth valve; and means for connecting said fourth valve between said second outlet port and said second exit port so that said fourth valve is disposed within said second hollow region; and said fourth communicating means includes:

a third entry port defined through said first skirt portion;

a third inlet port defined through said primary confinement receptacle in communication with said second cavity;

a fifth valve; and means for connecting said fifth valve between said third entry port and said third inlet port so that said fifth valve is disposed within said first hollow region.

13. An apparatus as defined in claim 12, wherein:

said first skirt portion has defined therein:

a first access port through which an implement is insertable for actuating said first valve;

a second access port through which an implement is insertable for actuating said second valve; and a third access port through which an implement is insertable for actuating said fifth valve; and said second skirt portion has defined therein:

a fourth access port through which an implement is insertable for actuating said third valve; and a fifth access port through which an implement is insertable for actuating said fourth valve.

14. An apparatus as defined in claim 10, wherein said primary confinement receptacle includes:

a first end wall;

an outer side wall connected at one end to said first end wall;

a second end wall connected to another end of said outer side wall; and an inner side wall defining said first cavity so that said first cavity extends centrally within said primary confinement receptacle between said first and second end walls, said inner side wall spaced from said outer side wall so that an annular chamber, defining said second cavity, exists between said inner and outer side walls to define said second cavity around said first cavity and separated therefrom by said inner side wall.

* * * * *